US009334625B2

(12) United States Patent
Hong et al.

(10) Patent No.: US 9,334,625 B2
(45) Date of Patent: May 10, 2016

(54) BUFFER SYSTEM FOR MINING DEEP SEAFLOOR MINERAL RESOURCE

(71) Applicant: KOREA INSTITUTE OF OCEAN SCIENCE & TECHNOLOGY, Ansan-si, Gyeonggi-do (KR)

(72) Inventors: Sup Hong, Daejeon (KR); Jong-Su Choi, Daejeon (KR); Hyung-Woo Kim, Daejeon (KR); Tae-Kyeong Yeu, Daejeon (KR); Cheon-Hong Min, Daejeon (KR)

(73) Assignee: Korea Institute of Ocean Science & Technology, Ansan-si (KR)

( * ) Notice: Subject to any disclaimer, the term of this patent is extended or adjusted under 35 U.S.C. 154(b) by 0 days.

(21) Appl. No.: 14/512,989

(22) Filed: Oct. 13, 2014

(65) Prior Publication Data

US 2015/0101963 A1 Apr. 16, 2015

(30) Foreign Application Priority Data

Oct. 16, 2013 (KR) ..... 10-2013-0123635

(51) Int. Cl.
*B03B 9/00* (2006.01)
*E02F 7/00* (2006.01)
(Continued)

(52) U.S. Cl.
CPC . *E02F 7/005* (2013.01); *B07C 5/36* (2013.01); *E02F 7/023* (2013.01); *E02F 7/06* (2013.01); *E21C 50/00* (2013.01)

(58) Field of Classification Search
CPC ..... E02F 7/06; E02F 7/023; E02F 7/005
USPC ..... 209/2; 37/309, 314
See application file for complete search history.

(56) References Cited

U.S. PATENT DOCUMENTS 4,123,858 A 11/1978 Batchelder
4,141,159 A * 2/1979 Morris ..... E02F 3/88 241/1

(Continued)

FOREIGN PATENT DOCUMENTS

FR 2974585 A1 11/2012
JP 50-122402 A 9/1975

(Continued)

OTHER PUBLICATIONS

European Search Report for Application No. 14188933.7, dated Mar. 25, 2015, 6 pages.

(Continued)

*Primary Examiner* — Terrell Matthews
(74) *Attorney, Agent, or Firm* — Lewis Roca Rothgerber Christie LLP

(57) ABSTRACT

Disclosed is a buffer system for mining a deep seafloor mineral resource. The buffer system includes a hopper part that introduces and stores a crushed mineral resource to discharge the crushed mineral resource upward, a first pipe that communicates with an upper portion of the hopper part to introduce the mineral resource, a feeder part provided under the hopper part to discharge the mineral resources upward, a second pipe that communicates with the feeder part and lifts the mineral resource, a hydraulic part provided under the hopper part to convert power received from a surface boat into hydraulic power to operate at least one actuator and a driving motor to introduce the mineral resource into the first pipe, and a structure frame coupled to a lifting pipe to transmit an external load applied to the buffer system, and constituting an external frame of the buffer system to protect internal units.

11 Claims, 5 Drawing Sheets

(51) Int. Cl.

| | |
|---|---|
| ***E21C 50/00*** | (2006.01) |
| ***B07C 5/36*** | (2006.01) |
| ***E02F 7/02*** | (2006.01) |
| ***E02F 7/06*** | (2006.01) |

(56) References Cited

U.S. PATENT DOCUMENTS

| | | | | | |
|---|---|---|---|---|---|
| 4,155,491 | A * | 5/1979 | Istoshin | E02F 7/005 | 222/371 |
| 4,232,903 | A * | 11/1980 | Welling | E02F 3/8858 | 241/1 |
| 4,503,629 | A * | 3/1985 | Uchida | E02F 3/88 | 198/812 |
| 4,685,742 | A * | 8/1987 | Moreau | E02F 3/8858 | 299/8 |
| 7,690,135 | B2 * | 4/2010 | Yu | E02F 3/8858 | 37/309 |
| 2009/0304462 | A1 | 12/2009 | Yoon et al. | | |

FOREIGN PATENT DOCUMENTS

| | | |
|---|---|---|
| JP | 58-094596 | 6/1983 |
| JP | 60-212591 | 10/1985 |
| JP | 62-129494 | 8/1987 |
| JP | 2013-528727 | 7/2013 |
| KR | 10-0664732 | 12/2006 |
| KR | 10-0664733 | 12/2006 |
| KR | 10-2012-0067072 | 6/2012 |
| KR | 10-2013-0095468 | 8/2013 |
| WO | WO 2012/146730 A1 | 11/2012 |

OTHER PUBLICATIONS

Japanese Office Action dated Aug. 28, 2015 of the corresponding Japanese Patent Application No. 2014-208951, noting listed references in this IDS (8 pages).

* cited by examiner

BUFFER SYSTEM FOR MINING DEEP SEAFLOOR MINERAL RESOURCE

CROSS-REFERENCE TO RELATED APPLICATION(S)

This application claims priority to and benefit of Korean Patent Application Number 10-2013-0123635, filed on Oct. 16, 2013, the entire disclosure of which is incorporated herein by reference.

BACKGROUND OF THE INVENTION

1) Field of the Invention

The present invention relates to a buffer system of a system for mining deep seafloor mineral resources including a manganese nodule. More particularly, the present invention relates to a buffer system for mining deep seafloor mineral resources by performing a function of storing crushed minerals, which are mined, discharged, and transferred by a mining robot, into the buffer system, a function of introducing a specified amount of crushed minerals for flow assurance in a lifting process to transfer the crushed minerals in a slurry state from the buffer system to a surface boat through a lifting pipe, and a function of preventing a pendulum motion of the buffer system coupled to the lifting pipe.

2) Background of Related Art

Deep seafloor mineral resources mainly include manganese nodules, seafloor hydrothermal deposits, and manganese pavement. The deep seafloor mineral resources are in a market entry step for actual production.

In particular, the manganese nodules are polymetallic nodules containing copper (Cu), cobalt (Co), nickel (Ni), and manganese (Mn). Among the polymetallic nodules, Mn occupies the highest content. Generally, since a lump of Mn has the shape of a potato, the lump of Mn is called "manganese nodule". The lump of Mn has a diameter of 40 mm to 60 mm on average, and has a concentric structure formed about a core of the manganese nodule, like a tooth of a shark, a fragment of the manganese nodule, and a stone The manganese nodule has a great industrial value, so that studies on the commercial mining of Mn have been conducted in Ocean management incorporated (OMI) in the late 1970s. Regarding a mining system, various schemes have been suggested.

Korean Patent Registration No. 10-0664732 (issued on Dec. 27, 2006) discloses a buffer for mining deep seafloor minerals, which includes a frame 10 having a predetermined receiving space. An upper portion of the buffer communicates with a lifting pipe 40 fixedly installed on a ceiling of the frame 10 and coupled to a surface boat, and a lower portion of the buffer has a discharge port 22 used to discharge nodules. The buffer is provided at a lateral side thereof with a branch pipe 21 branching at a predetermined angle and having an end portion communicating with a flexible pipe 50. A lower end portion of the buffer in which the discharge port 22 is positioned is bent at a predetermined angle to prevent a structure from being damaged due to the discharge of the nodules. The buffer includes a connection pipe 20 coupled to a support plate 11, which is coupled to the frame 10 and supported to the frame 10, while passing through the support plate 11, so that the buffer can be stably supported. The buffer includes first and second check valves 21a and 22a installed on an inner circumference of the branch pipe at a branch position and an upper inner circumference of the discharge port 22 to move the nodule in one direction.

However, the related art does not suggest functions of storing crushed minerals, which are mined, discharged, and transferred by a mining robot, into a buffer system, of introducing a specified amount of crushed minerals for flow assurance in a lifting process to transfer the crushed minerals in a slurry state from the buffer system to a surface boat through a lifting pipe, and of preventing a pendulum motion of the buffer system coupled to the lifting pipe As a prior art, there is provided Korean Patent Registration No. 10-0664732 (issued on Dec. 27, 2006).

SUMMARY OF THE INVENTION

The present invention is made keeping in mind problems occurring in a related, and an object of the present invention is to provide a buffer system for mining deep seafloor mineral resources by performing a function of storing crushed minerals, which are mined, discharged and transferred by a mining robot, into the buffer system, a function of introducing a specified amount of crushed minerals for flow assurance in a lifting process to transfer the crushed minerals in a slurry state from the buffer system to a surface boat through a lifting pipe, and a function of preventing a pendulum motion of the buffer system coupled to the lifting pipe.

In order to accomplish the object of the present invention, there is provided a buffer system for mining a deep seafloor mineral resource. The buffer system includes a hopper part that introduces and stores a crushed mineral resource to discharge the crushed mineral resource upward, a first pipe that communicates with an upper portion of the hopper part to introduce the mineral resource, a feeder part provided under the hopper part to discharge the mineral resources upward, a second pipe that communicates with the feeder part and lifts the mineral resource, a hydraulic part provided under the hopper part to convert power received from a surface boat into hydraulic power to operate at least one actuator as well as a driving motor to introduce the mineral resource into the first pipe, and a structure frame coupled to a lifting pipe to transmit an external load applied to the buffer system, and constituting an external frame of the buffer system to protect internal units.

In addition, the buffer system for mining the deep seafloor mineral resource according to the present invention includes a measurement control unit to remotely control the feeder part and the hydraulic part.

In addition, according to the present invention, the buffer system includes a propelling unit to prevent a pendulum motion of the buffer system and to control a forward direction of the buffer system.

Meanwhile, in the buffer system for mining the deep seafloor mineral resource according to the present invention includes, the measurement control unit is provided in at least one pressure-resistant container to endure pressure under deep sea.

According to the present invention, the hopper part includes a separation part provided at an upper portion of the hopper part to separate deposits from the mineral resource introduced through the first pipe, and a storage and discharge part to store the mineral resource separated by the separation part and to uniformly discharge the stored mineral resource to the feeder part.

Meanwhile, according to the present invention, the feeder part is provided therein with a feeder having a shape of a screw.

In addition, according to the present invention, the structure frame includes an upper frame having a convex-conical structure and provided at an upper most end of the structure frame, an intermediate frame having a cylindrical structure and provided at an intermediation portion of the structure frame, a lower frame having a concave-cylindrical structure and provided at a lower portion of the structure frame, and a base frame having a cylindrical structure, provided at a lower most end of the structure frame, not used during an operation of the buffer system, and supporting the structure frame in a standby state on a ship. The upper frame, the intermediate frame, and the lower frame are coupled to each other through a bolt-nut scheme to construct one structure, and the structure is placed on a base frame in a fixed state, and includes at least three wire fixing lugs. Each of the upper frame, the intermediate frame, the lower frame, and the base frame comprises eight vertical members. Meanwhile, the base frame is used to store the buffer system on a ship and used for the purpose of maintenance of the buffer system. The integrated buffer system is placed on the base frame, and the frames of the buffer system are coupled to peripheral portions of the base frame through additional wires, so that the buffer system is easily fixed.

Further, according to the present invention, a first external force cancelling unit is provided between the upper frame and a coupling portion between the second pipe and the lifting pipe, and a second external force cancelling unit is provided between the lower frame and a coupling portion of the first pipe and the flexible pipe.

According to the present invention, a lower portion of the second pipe is perpendicularly coupled to a discharge pipe to communicate with the second pipe and to discharge the dropped mineral resources to a deep seafloor.

In addition, according to the present invention, the mineral resource includes a manganese nodule.

The advantages and features of the present invention will be apparently comprehended by those skilled in the art based on the following detailed description made with reference to accompanying drawings.

Terms and words used in the specification and the claims shall not be interpreted as commonly-used dictionary meanings, but shall be interpreted as to be relevant to the technical scope of the invention based on the fact that the inventor may properly define the concept of the terms to explain the invention in best ways.

As described above, according to various embodiments of the present invention, the crushed nodules mined, discharged, and transferred by the mining robot can be stored in the hopper.

In addition, according to various embodiment of the present invention, a specific amount of crushed nodules can be introduced for the flow assurance of the stored mineral resources in the slurry state in lifting.

In addition, according to various embodiments of the present invention, the pendulum motion of the lifting pipe and the buffer system can be prevented, so that the adjustment performance of an interval between the buffer system and the mining robot can be improved.

Therefore, according to the various embodiments of the present invention, the variation in an amount of mineral resources mined on the deep seafloor can be actively managed and the operating efficiency of the system for mining the deep seafloor mineral resources can be enhanced, so that the economical effects of mineral mining can be improved.

DETAILED DESCRIPTION OF THE INVENTION

Figure 1:
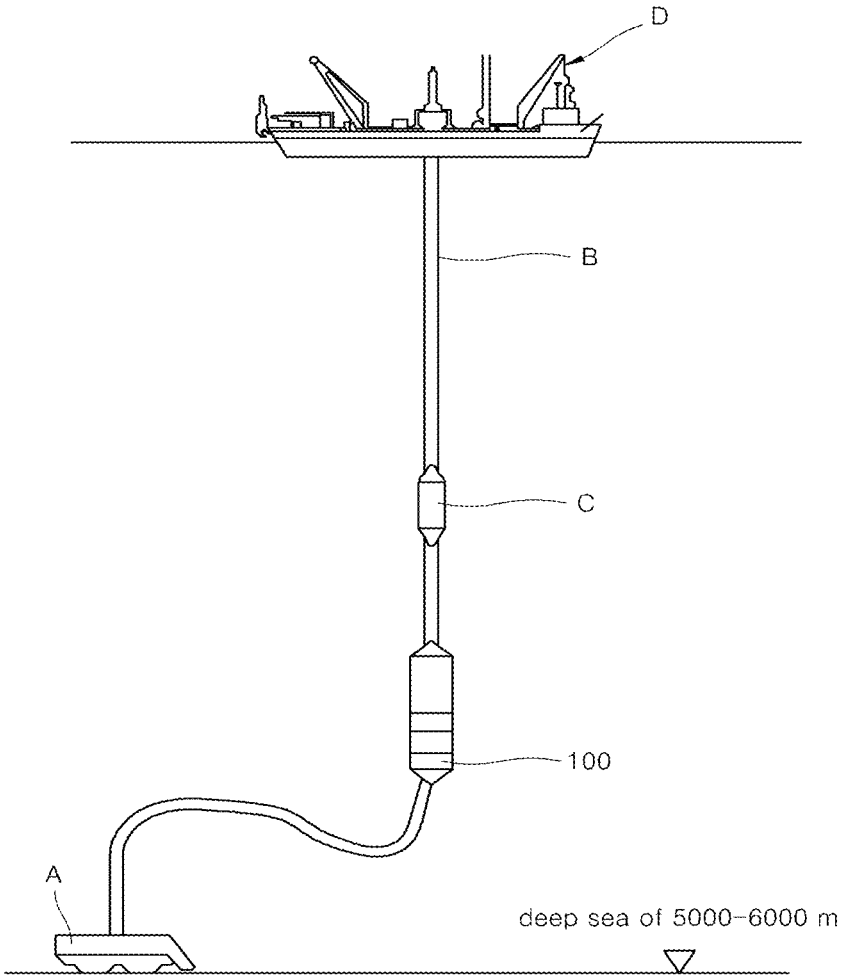
FIG. 1 is a view schematically showing a system for mining deep seafloor minerals, which includes a buffer system to mine the deep seafloor minerals according to an embodiment of the present invention.

The objects, the specific advantages, and the novel features of the present invention will be apparently comprehended by those skilled in the art based on the embodiments, which are detailed later in detail, together with accompanying drawings.

In the following description, the same reference numerals will be used to refer to the same elements throughout the drawings. Although the terms "first" and "second" may be used in the description of various elements, the embodiment is not limited thereto. The terms "first" and "second" are used to distinguish one element from the other elements.

As used herein, singular forms used in the following description are intended to include the plural forms as well, unless the context clearly indicates otherwise. In the following description, when a predetermined part "includes" a predetermined component, the predetermined part does not exclude other components, but may further include other components if there is a specific opposite description.

In the following description referring to FIGS. 1 to 7, the same reference numerals will be assigned to the same elements.

In addition, in the following description, if detailed description about well-known functions or configurations may make the subject matter of the disclosure unclear, the detailed description will be omitted.

Hereinafter, exemplary embodiments of the present invention will be described in detail with reference to accompanying drawings.

FIG. 1 is a view schematically showing a system for mining deep seafloor minerals, which includes a buffer system to mine the deep seafloor minerals according to an embodiment of the present invention.

Referring to FIG. 1, the system for mining the deep seafloor minerals according to the embodiment of the present invention includes a mining robot A, a lifting pipe B, a lifting pump C, a buffer system 100, and a surface boat D on the sea.

The system for mining the deep seafloor minerals according to the embodiment of the present invention provides mineral resources, which are placed at a deep sea floor (at the depth of 5000 m to 6000 m) mined and crushed by the mining robot A to the surface boat D through the lifting pipe B couple with a bottom portion of the surface boat D.

In this case, the buffer system 100 stores crushed nodules mined, discharged, and transferred by the mining robot A into a reservoir. In addition, the buffer system 100 feeds a specified amount of crushed nodules to the surface boat D through the lifting pipe B for the flow assurance of the lifted manganese nodules The buffer system 100, which has the above function and is used to mine the mineral resources on the deep seafloor according to the embodiment of the present invention, will be described in detail with reference to FIG. 2.

Figure 2:
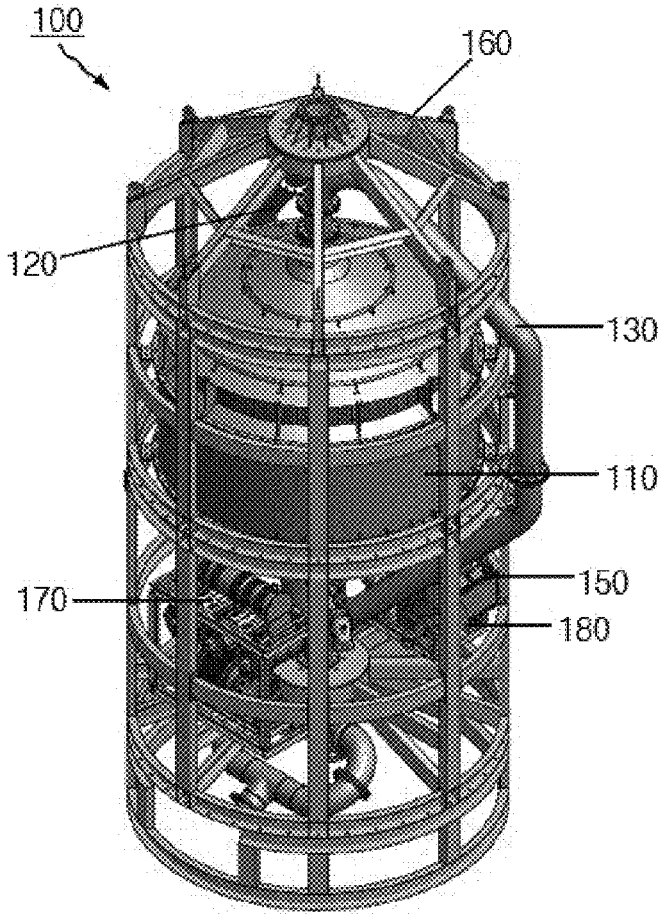
FIG. 2 is a view showing an example of the buffer system used to mine the deep seafloor according to the embodiment of the present invention.

FIG. 2 is a view showing an example of the buffer system used to mine the deep seafloor according to the embodiment of the present invention.

Referring to FIG. 2, the buffer system 100 used to mine the deep seafloor according to the embodiment of the present invention includes a hopper part 110, which is used to introduce and store the crushed mineral resources to discharge the crushed mineral resources upward, a first pipe 120 configured to communicate with an upper portion of the hopper part 110 to introduce the mineral resources, a feeder part 140 configured to communicate to a lower portion of the hopper part 110 to discharge the mineral resources upward (see FIGS. 5 and 6), a second pipe 130 configured to communicate to the feeder part 140 to lift the mineral resources, a hydraulic part 150 to convert power received from the surface boat D into hydraulic power to operate various types of actuators as well as a driving motor 142 of the feeder part 140, and a structure frame 160 coupled to the lifting pipe B to transmit an applied to the buffer system 100, and forming an external frame to protect internal units.

Hereinafter, the buffer system 100 used to mine the deep seafloor according to the embodiment of the present invention and having the structure shown in FIG. 2 will be described in detail.

First, the structure frame 160 will be disclosed

The structure frame 160 transmits a load to the lifting pipe (not shown) in order to form an external skeleton construction of the buffer system 100 to protect the internal units. Hereinafter, the details of the structure frame 160 will be described with reference to FIG. 3.

Figure 3:
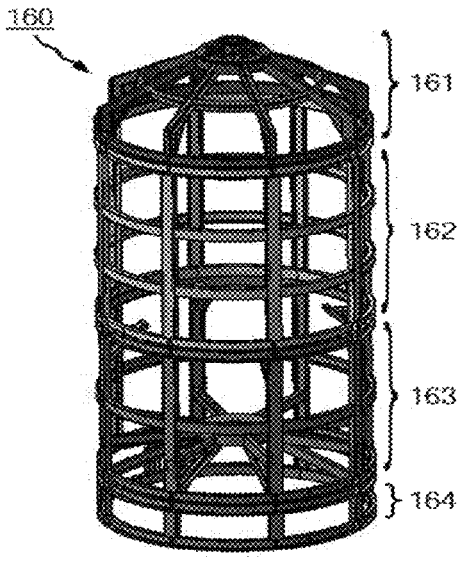
FIG. 3 is a view showing the structure frame according to the embodiment of the present invention.

FIG. 3 is a view showing the structure frame 160 according to the embodiment of the present invention.

Referring to FIG. 3, the structure frame 160 includes an upper frame 161 having a conical structure and provided at the uppermost end of the structure frame 160, an intermediate frame 162 having a cylindrical structure and provided at an intermediation portion of the structure frame 160, a lower frame 163 having an enforced cylindrical structure and provided at a lower portion of the structure frame 160, and a base frame 164 having a cylindrical structure and provided at the lower most end of the structure frame 160 to support the structure frame 160 when the structure frame 160 is shipped and stored.

In other words, the structure frame 160 according to the embodiment of the present invention has a 4-stage separation structure of the upper frame 161, the intermediate frame 162, the lower frame 163, and the base frame 164.

The upper frame 161 is positioned at the upper most portion of the buffer system 100, coupled to the lifting pipe at the central upper portion thereof, and coupled to the second pipe 130 at the central lower portion thereof.

In particular, the upper frame 161 is provided at the central upper portion thereof with a first external force cancelling unit. One surface of the first external force cancelling unit is coupled to the upper frame 161, and an opposite surface of the first external force cancelling unit is coupled to the lifting pipe.

In addition, preferably, the structure frame 160 includes a material of SS400 channel type steel, but the embodiment is not limited thereto.

Meanwhile, the lower frame 163 is provided at the central upper portion thereof with a second external force cancelling unit. One surface of the second external force cancelling unit is coupled to the lower frame 163, and an opposite surface of the second external force cancelling unit is coupled to an introduction pipe.

In this case, the lifting pipe is a flow pipe to transfer the mineral resources stored in the buffer system 100 to the surface boat D on a sea surface. The introduction pipe is a flexible pipe which introduces the mineral resources from the mining robot A to the buffer system 100 to allow the interval variation under a predetermined degree between the mining robot A and the buffer system 100.

Preferably, the frames are sequentially coupled to each other upward from the lower frame through a bolt-nut scheme.

After the frames have been assembled with each other, a spotting process is performed with respect to the assembled frames and the assembled frames are coated with epoxy, therebypreventing the frames from being corroded by sea water. In addition, the frames include a plurality of vertical members in order to endure the pressure applied to the frames under the deep sea. According to the embodiment of the present invention, eight vertical members are provided, but the present invention is not limited thereto.

Referring to FIG. 2 again, the hopper part 110 has a body embedded in the intermediate frame 162.

The hopper part 110 embedded in the intermediate frame 162 as described above will be described below with reference to FIGS. 4 and 5.

Figure 4:
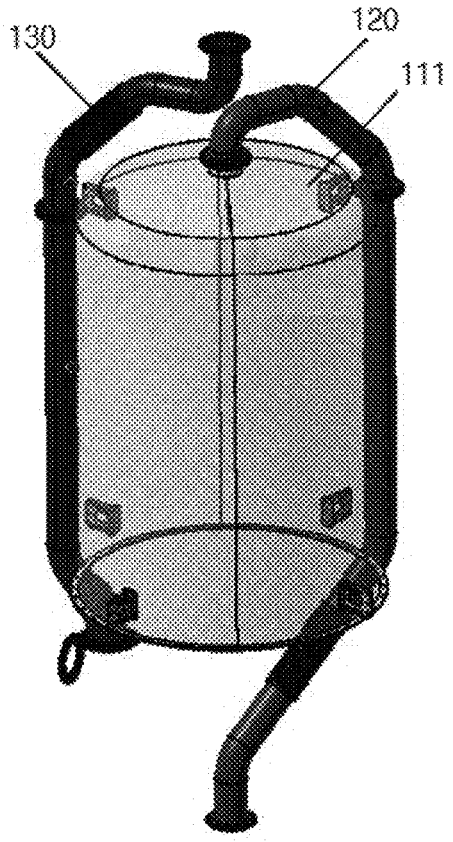
FIG. 4 is a view showing an upper portion of the hopper part according to the embodiment of the present invention
Figure 5:
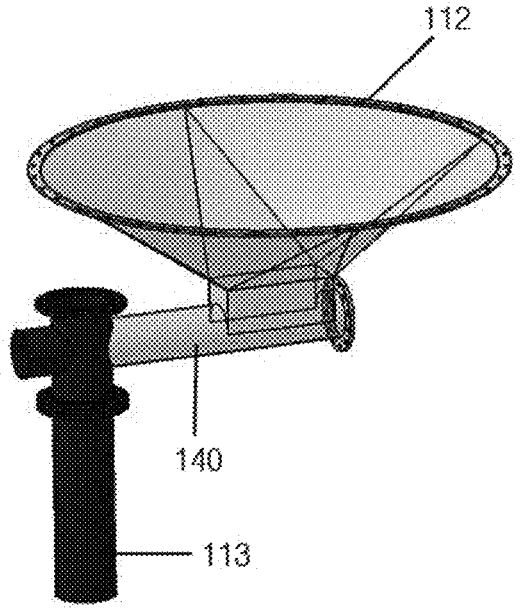
FIG. 5 is a view showing a lower portion of a hopper part and a housing of the feeder part according to the embodiment of the present invention.

FIG. 4 is a view showing an upper portion 111 of the hopper part 110 according to the embodiment of the present invention, and FIG. 5 is a view showing a lower portion 112 of the hopper part 110 and a housing of the feeder part 140 according to the embodiment of the present invention.

Referring to FIG. 4, the upper portion 111 of the hopper part 110 according to the embodiment of the present invention has the center of the upper most end coupled to the first pipe 120 used to introduce the mineral resources from the mining robot A so that the upper portion 111 of the hopper part 110 communicates with the first pipe 120.

In addition, although not shown, preferably, the hopper part 110 includes a unit to separate deposits from the crushed mineral resources introduced through the first pipe 120.

Meanwhile, the feeder part 140 transfers the crushed mineral resources to the lifting pipe through the second pipe 130.

Regarding the coupling relationship of the feeder part 140 referring to FIG. 5, one end of the feeder part 140 according to the embodiment of the present invention is coupled to a lower portion 112 of the hopper part 110 to communicate with the lower portion 112 of the hopper part 110. An opposite end of the feeder part 140 is coupled to the second pipe 130 to communicate with the second pipe 130.

The feeder part 140 according to the embodiment of the present invention will be described in detail with reference to FIG. 6.

In this case, the feeder part 140 communicates with the second pipe 130 while forming a substantially right angle therebetween for following reasons.

If the system erroneously operates so that the mineral resources are not lifted up, the mineral resources are dropped down due to the self weight thereof.

If the dropped mineral resources are introduced into the hopper part 110 again, the storage limit of the hopper part 110 is exceeded, so that the hopper part 110 may be damaged due to an excessive amount of mineral resources that are introduced therein.

Accordingly, a lower portion of the second pipe 130 is perpendicularly coupled to a discharge pipe 113 to communicate with the second pipe 130 to discharge the dropped mineral resources to an outside of the buffer system.

In other words, mineral resources fed from the feeder part 140 can be easily transferred through the second pipe 130, and mineral resources dropped in the second pipe 130 are dropped to a sea floor through the discharge pipe 113, thereby preventing mineral resources from being excessively introduced into the hopper part 110 to protect the hopper 110.

Figure 6:
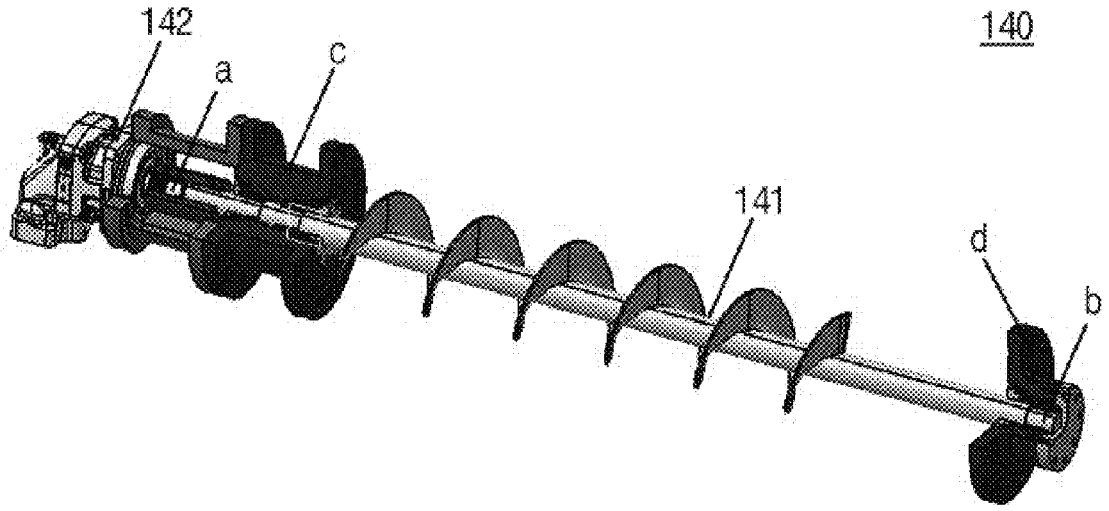
FIG. 6 is a perspective view showing the detailed internal structure of the feed part according to the embodiment of the present invention.

FIG. 6 is a perspective view showing the detailed internal structure of the feed part according to the embodiment of the present invention.

Referring to FIG. 6, the feeder part 140 according to the embodiment of the present invention includes a screw 141 and a driving motor 142.

The feeder part 140 introduces mineral resources, which are temporarily stored in the hopper part 110, into the second pipe 130 by amount appropriate to lifting.

In this case, the screw 141 preferably includes an Archimedean screw. The driving motor 142 preferably includes a hydraulic motor, but the present invention is not limited thereto.

Bearings a and b and couplings c and d are provided at both ends of the screw 141 and the screw 141 is preferably coupled to a pressure compensator (not shown) filled with oil.

In particular, when the feeder part 140 is assembled, a stainless bolt is used for the coupling of the feeder part 140, and special waterproof grease is used.

Preferably, the feeder part 140 is formed of STS304, but the present invention is not limited thereto.

The feeder part 140 is preferably driven by a measurement control unit 170 to be described below.

Next, the hydraulic part 150 is disclosed.

The hydraulic part 150 may include a reservoir and an actuator, an HPU, a hydraulic fluid pressure compensator, a pressure compensator for electrical parts, filters, a remote pressure control valve, a relief valve, valve packs, and a controller.

The hydraulic part 150 is designed for the use at the deep seafloor, and conceptually is identical to a hydraulic system of the mining robot A.

In addition, the buffer system 100 used to mine the deep seafloor mineral according to the embodiment of the present invention further includes a measurement control unit 170.

Figure 7:
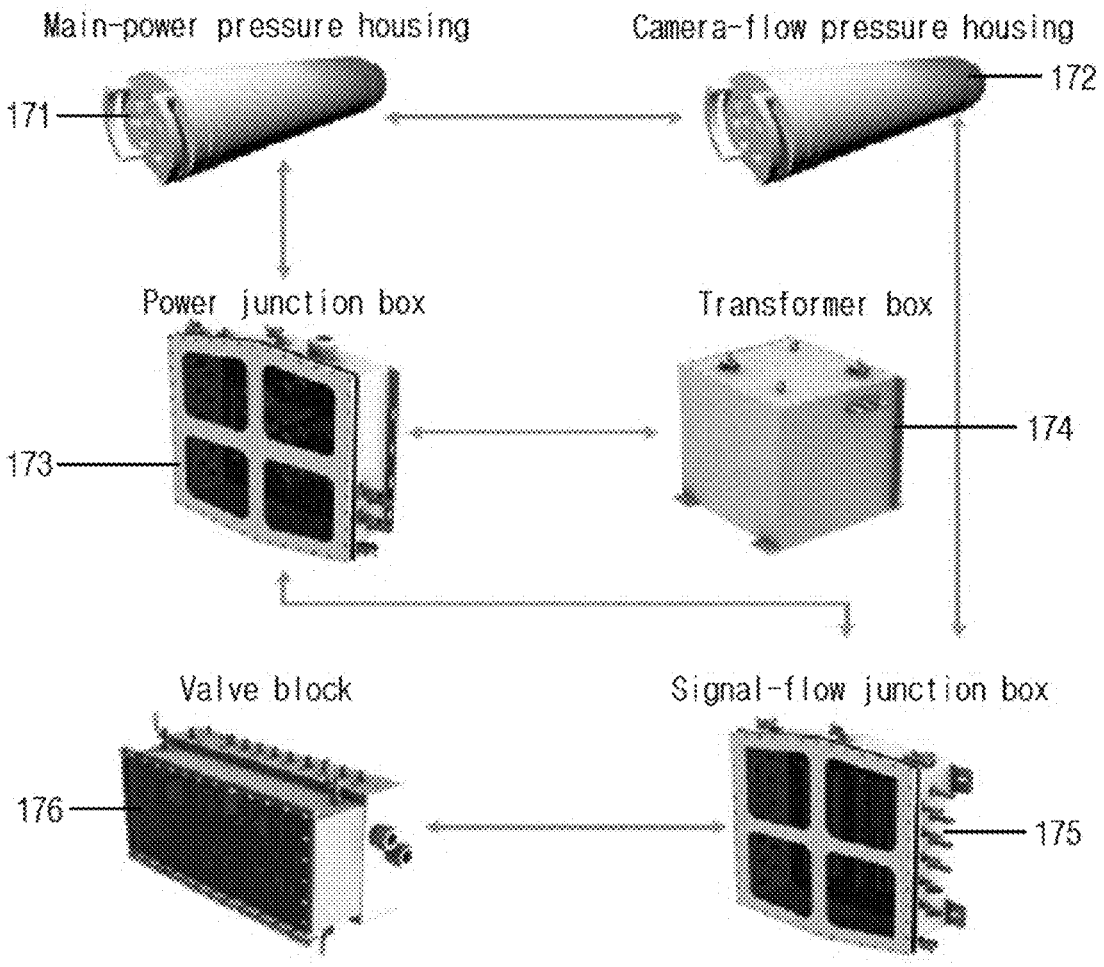
FIG. 7 shows components of a measurement control unit according to the embodiment of the present invention.

FIG. 7 shows components of the measurement control unit according to the embodiment of the present invention.

Referring to FIG. 7, the measurement control unit 170 includes a main-power pressure housing 171, a camera-flow pressure housing 172, a power junction box 173, a Trans box 174, a signal-flow junction box 175, and a valve block 176.

Hereinafter, the measurement control unit 170 according to the embodiment of the present invention will be described in detail with reference to FIG. 7.

The buffer system 100 according to the embodiment of the present invention requires a pressure-resistant container having a power supply function, a control function, a monitoring function, and a communication function for sensors and electronic devices for the operation of the buffer system 100.

The main-power pressure housing 171 preferably has the function of a main pressure resistant container serving as a central controller and the function of a power pressure resistant container for the power supply of all sensors and the electronic devices.

The main-power pressure housing 171 is installed therein with a diming board having a remote controller function, a switching mode power supply (SMPS) function, a communication conversion device function, a navigation sensor function, and a function of adjusting the brightness of LED lighting to transmit signals of actuators and sensors to a Control Van to operate the measurement control unit 170 (see FIG. 2) through optical communication.

In particular, the SMPS employs a product less emitting heat to prevent functions of the electronic devices from being degraded due to heat.

Further, preferably, an internal frame of the main-power pressure housing 171 is efficiently arranged by distinguishing between cases that a heat source exists and do not exist.

For example, the main-power pressure housing 171 has an internal plate frame structure designed to represent excellent heat circulation in match with a cylinder structure allowing the smooth flow of air in a sealed pressure-resistance container, thereby minimizing heat problems.

Meanwhile, the camera-flow pressure housing 172 has a visual monitoring function of the buffer system 100 to collect information of sensors, such as a flux, hydraulic pressure, water leakage, and oil pressure, and to transmit the information of the sensors to a control chamber of the surface boat D.

The camera-flow pressure housing 172 has a function of converting an analogue signal from an underwater camera into a digital signal to transmit a signal through LAN communication and a function of controlling Pan & Tilt. In addition, the camera-flow pressure housing 172 has a function of collecting information from a depth sensor, a flux measuring sensor of hydraulic pressure actuators, a water leakage sensor, or an oil pressure sensor to verify the safety from the water pressure of each pressure compensator to transmit the information through a serial communication.

Meanwhile, the pressure compensator of the buffer system 100 includes the power junction box 173, the Trans box 174, the signal-flow junction box 175, and the valve block 176.

The power junction box 173 distributes 220V-power received from the Trans box 174 and supplies the power to the HPU.

The Trans box 174 receives high voltage (2800 V, 3300 V) of the surface boat D and converts the high voltage into 220V driving voltage for electronic equipment. In this case, signal transmission may be difficult due to noise caused by a step-down transformer.

Accordingly, in order to smoothly transmit a signal, a noise cut transformer, which can effectively reduce noise, is preferably applied to the Trans box 174.

The signal-flow junction box 175 transmits sensor signals related to water leakage, oil leakage, and temperature leakage.

In particular, preferably, the signal-flow junction box 175 is configured by reducing functions of a signal junction box to transmit and branch a signal of the mining robot A and a flow junction box to perform the power supply and signal transmission of a flow sensor.

The signal-flow junction box 175 is preferably configured to control an actuator to drive a transmission pump of a hydraulic control valve (PWM16) buffer of the valve block 176 and stably control a hydraulic pressure by applying a board to prevent back EMF voltage.

Meanwhile, the measurement control unit 170 of the buffer system 100 has a following wiring scheme.

Preferably, an underwater wiring scheme of the measurement control unit 170 includes a self-maintenance scheme and an oil compensation scheme to use a PBOF connector appropriate to a high pressure deep sea environment.

In addition, as a connector of a reservoir that does not require maintenance, a mold-type connector is preferably used instead of an existing PBOF connector having excellent maintainability, so that costs can be reduced.

The communication scheme of the measurement control unit 170 is preferably designed to make serial communication and LAN communication between sensors, so that a wiring number can be reduced, and a communication rate can be increased.

Referring to FIG. 2, preferably, the buffer system 100 according to the embodiment of the present invention further includes a propelling unit 180 to prevent the pendulum motion of the lifting pipe and the buffer system 100, and to control the preventing of the pendulum motion of the buffer system 100 and a forward direction of the buffer system 100.

Although the present invention has been described by making reference to the embodiments and accompanying drawings, it should be understood that the present invention is not limited to the embodiments but includes all modifications, equivalents and alternatives. Accordingly, those skilled in the art should understand the spirit and scope of the present invention as defined in the following claims. In addition, those skilled in the art should understand that the equivalents and the modifications belong to the scope of the spirit of the present invention.

What is claimed is:

1. A buffer system for mining a deep seafloor mineral resource, the buffer system comprising:

a hopper part that introduces and stores a crushed mineral resource to discharge the crushed mineral resource upward;

a first pipe that communicates with an upper portion of the hopper part to introduce the mineral resource;

a feeder part provided under the hopper part to discharge the mineral resources upward;

a second pipe that communicates with the feeder part and lifts the mineral resource;

a hydraulic part provided under the hopper part to convert power received from a surface boat into hydraulic power to operate at least one actuator and a driving motor to introduce the mineral resource into the first pipe;

a structure frame coupled to a lifting pipe to transmit an external load applied to the buffer system, and constituting an external frame of the buffer system to protect internal units; and a measurement control unit to remotely control the feeder part and the hydraulic part, wherein the measurement control unit is provided in at least one pressure-resistant container to endure pressure under deep sea.

2. The buffer system of claim 1, wherein the hopper part comprises:

a separation part provided at an upper portion of the hopper part to separate deposits from the mineral resource introduced through the first pipe; and a storage and discharge part to store the mineral resource separated by the separation part and to uniformly discharge the stored mineral resource to the feeder part.

3. The buffer system of claim 1, wherein the feeder part is provided therein with a feeder having a shape of a screw.

4. The buffer system of claim 1, wherein the feeder part has one end perpendicularly communicating with one end of the second pipe.

5. The buffer system of claim 1, wherein the structure frame comprises:

an upper frame having a convex-conical structure and provided at an upper most end of the structure frame;

an intermediate frame having a cylindrical structure and provided at an intermediation portion of the structure frame;

a lower frame having a concave-cylindrical structure and provided at a lower portion of the structure frame; and a base frame having a cylindrical structure, provided at a lower most end of the structure frame, not used during an operation of the buffer system, and supporting the structure frame in a standby state on a ship.

6. The buffer system of claim 5, wherein the upper frame, the intermediate frame, the lower frame, and the base frame are coupled to each other through a bolt-nut scheme, and each of the upper frame, the intermediate frame, the lower frame, and the base frame comprises eight vertical members.

7. The buffer system of claim 5, wherein the upper frame, the intermediate frame, and the lower frame are coupled to each other through a bolt-nut scheme to construct one structure, and the structure is placed on a base frame in a fixed state, and includes at least three wire fixing lugs.

8. The buffer system of claim 5, wherein the upper frame comprises a first external force cancelling unit formed at a coupling portion with the second pipe, and the lower frame comprises a second force external cancelling unit formed at a coupling portion with the first pipe.

9. The buffer system of claim 1, further comprising a propelling unit to prevent a pendulum motion of the buffer system and to control the prevention of the pendulum motion of the buffer system and a forward direction of the buffer system.

10. The buffer system of claim 1, wherein a pipe is perpendicularly coupled to a lower portion of the second pipe to communicate with the second pipe and to discharge a dropped mineral resource to an outside of the buffer system.

11. The buffer system of claim 1, wherein the mineral resource includes a manganese nodule.

* * * * *